United States Patent [19]

Braun

[11] Patent Number: 4,753,103

[45] Date of Patent: Jun. 28, 1988

[54] ARRANGEMENT FOR THE FEEDING OF SHEET-METAL BLANKS TO THE DRAWING STAGE OF A TRANSFER PRESS

[75] Inventor: Hans Braun, Weilheim, Fed. Rep. of Germany

[73] Assignee: L. Schuler GmbH, Göppingen, Fed. Rep. of Germany

[21] Appl. No.: 802,003

[22] PCT Filed: Oct. 2, 1984

[86] PCT No.: PCT/DE84/00201

§ 371 Date: Nov. 13, 1985

§ 102(e) Date: Nov. 13, 1985

[87] PCT Pub. No.: WO85/01459

PCT Pub. Date: Apr. 11, 1985

[30] Foreign Application Priority Data

Oct. 4, 1983 [DE] Fed. Rep. of Germany ..... 3335928

[51] Int. Cl.[4] ..... B21D 43/11; B21J 13/08

[52] U.S. Cl. ..... 72/405; 72/422; 198/345; 198/621; 414/121; 414/752

[58] Field of Search ..... 72/405, 421, 422; 198/345, 346.3, 468.2, 468.6, 773, 774, 621; 414/752, 751, 749, 750, 121; 271/13, 238, 240

[56] References Cited

U.S. PATENT DOCUMENTS

| | | | |
|---|---|---|---|
| 2,484,845 | 10/1949 | Nordquist et al. | 271/240 |
| 3,001,787 | 9/1961 | Socke | 271/240 |
| 3,456,814 | 7/1969 | Bautz . | |
| 3,563,360 | 2/1971 | Wickersheim | 198/621 |
| 3,939,992 | 2/1976 | Mikulec | 414/750 |
| 4,036,087 | 7/1977 | Braun | 83/79 |
| 4,088,522 | 5/1978 | Mercier et al. | 271/240 |
| 4,255,077 | 3/1981 | Smith | 198/345 |
| 4,259,052 | 3/1981 | Imanishi et al. | 72/405 |
| 4,311,304 | 1/1982 | Hamada et al. | 271/13 |
| 4,404,837 | 9/1983 | Allen et al. | 72/405 |
| 4,524,601 | 6/1985 | Bernardi | 72/422 |
| 4,533,239 | 8/1985 | Back | 271/236 |
| 4,536,118 | 8/1985 | Baba | 198/621 |
| 4,547,115 | 10/1985 | Charbonnet | 271/236 |

FOREIGN PATENT DOCUMENTS

| | | | |
|---|---|---|---|
| 1552003 | 1/1970 | Fed. Rep. of Germany . | |
| 2746048 | 4/1979 | Fed. Rep. of Germany . | |
| 2839269 | 5/1979 | Fed. Rep. of Germany . | |
| 2900526 | 1/1980 | Fed. Rep. of Germany . | |
| 56-461 | 5/1981 | Japan | 414/121 |
| 2099388 | 12/1982 | United Kingdom . | |

*Primary Examiner*—Daniel C. Crane

*Attorney, Agent, or Firm*—Barnes & Thornburg

[57] ABSTRACT

An arrangement for the feeding of sheet-metal blanks to a first machine stage is provided. A drawing stage of a transfer press is provided which has a conveying device for taking sheet-metal blanks from a supply pile and depositing them in an intermediate depositing stage adjacent the supply pile. The conveying means takes the sheet-metal blanks from the intermediate depositing stage to a first machining stage adjacent the intermediate depositing stage. Transfer rails are provided which can be driven in transfer direction, in lifting in lowering direction and in closing and opening direction. Gripping devices are attached to the transfer rails for the transport of the workpieces between the machining stages. The intermediate depositing stage includes a first intermediate depositing station in front of the drawing stage developed as an aligning station for the sheet-metal blanks with respect to the first machining station and has one of fixed and movable stop devices for the alignment of the sheet-metal blanks in the direction of the passage through the press. The transfer rails are extended and can thus be guided into an area of the first intermediate depositing station and passive gripping devices provided for reaching under the sheet-metal blanks during the transfer and for the depositing of the sheet-metal blanks in a second intermediate depositing station. Active gripping devices which can grip the sheet-metal blanks irrespective of the movement of the transfer rails are provided for removing the sheet-metal blanks from the second intermediate depositing station, for the gripping, transport and depositing in the drawing stage.

10 Claims, 3 Drawing Sheets

ARRANGEMENT FOR THE FEEDING OF SHEET-METAL BLANKS TO THE DRAWING STAGE OF A TRANSFER PRESS

This invention relates to an arrangement for the feeding of sheet-metal blanks to the first machining stage, especially to the drawing stage of a transfer press, having conveying means for taking sheet-metal blanks from a supply pile and for depositing them in an intermediate depositing station, for taking them from said intermediate depositing station and for transporting and depositing them in the first machining station, and having transfer rails that can be driven in transfer direction, in lifting and lowering direction and in closing and opening direction and having gripping devices arranged at said transfer rails for the transport of the workpieces between the machining stages.

The feeding of sheet-metal blanks to forming and reshaping tools in transfer presses today is fully automatic and as a rule requires only monitoring. Misrouting, such as a double-feeding of sheet-metal blanks, results in an early switching-off of the press or in the case of possible higher expenditures, during the supply in an ejection of the sheet-metal blank already in the feeding range witthout the switching-off of the press. However, for reasons of cost, the additional expenditures are decreased at the expense of the utilization of the press. In addition, in the case of transfer presses and especially those for large parts, a drawing stage is provided in the first machining stage in order to avoid a turning of the large-surface parts. The feeding of the sheet-metal blanks in this case requires extreme precision, means.

In DE-OS No. 29 00 526, a feeding arrangement for sheet-metal blanks to the first stage of a transfer press is described having the characteristics of this type. The sheet-metal blanks, by means of the suction lifting means of a vertical lifting mechanism, are taken from the supply pile, in the raised position are taken over by the suction cups of a horizontal conveying means and are fed to the transfer press. The feeding is timed with the press and takes place in a motion that is synchronous with the transfer rails between the machining stages. This feeding arrangement can only be used to a limited extent for transfer presses having a drawing stage as the first machining stage. The orientation of the sheet-metal blanks on the basis of the supply pile is not sufficient for a perfect depositing in the drawing tool, and it is not ensured that the indicated orientation is maintained on the transport route to the drawing stage.

In contrast, it is the objective of the invention to create an arrangement for the feeding of sheet-metal blanks to the first machining stage of a transfer press, by means of which, in the course of the feeding, the orienting of each sheet-metal blank takes place and is maintained. In this case, special value is placed on the separation of the orienting movements. For the alignment of the sheet-metal blanks in the direction of the passage through the press, the movement of the sheet-metal blank in this direction is to be utilized, and for an alignment of the sheet-metal blanks transversely to the direction of the passage through the press, the closing movement of the gripper rails is to be utilized.

In the case of arrangements of this type, the objective is achieved by the fact that two intermediate depositing stations are provided before the drawing stage, of which the first intermediate depositing station is developed as the aligning station for the sheet-metal blanks with respect to the first machining station, having fixed and possibly movable stopping means for the alignment of the sheet-metal blanks at least in the direciton of the passage through the press, and that the transfer rails are extended and can be guided into the area of the first intermediate depositing station in this way and in it in each case have passive gripping tools for reaching under the sheet-metal blanks during the transfer and for depositing said sheet-metal blanks in the second intermediate depositing station, and active gripping tools for taking the sheet-metal blanks out of the second intermediate depositing station for the purpose of gripping, conveying and depositing them in the drawing stage.

By means of the arrangement according to the invention, the sheet-metal blanks are gripped in an advantageous manner before, with the movement of the formed workpeices in the individual machining stages, the unformed blank is deposited in the drawing tool.

After having been lifted off the supply pile, the sheet-metal blanks, by means of a destacking device, via for example a roller conveyor, can be brought to conveying level and can be held in it. With the teaching of the conveying level, the first alignment of the sheet-metal blanks preferably takes place.

According to the invention the position of the sheet-metal blanks is advantageously maintained that was adjusted in passage direction by means of aligning station and imprecisions occurring during the long operation of the press are compensated. Irregularly shaped sheet-metal blanks, such as trapezoid sheet bars, can be gripped by the gripping tools of the transfer rails without loss of precision.

The advantageous suspending of the gripping tools by means according to the invention ensures a high constancy of precision with a good accessibility of the gripping tools.

The foregoing and other objects, features, and advantages of the present invention will become more apparent from the following description when taken in connection with the accompanyng drawings which show, for the purposes of illustration only, one embodiment in accordance with the present invention, and wherein.

Figure 1:
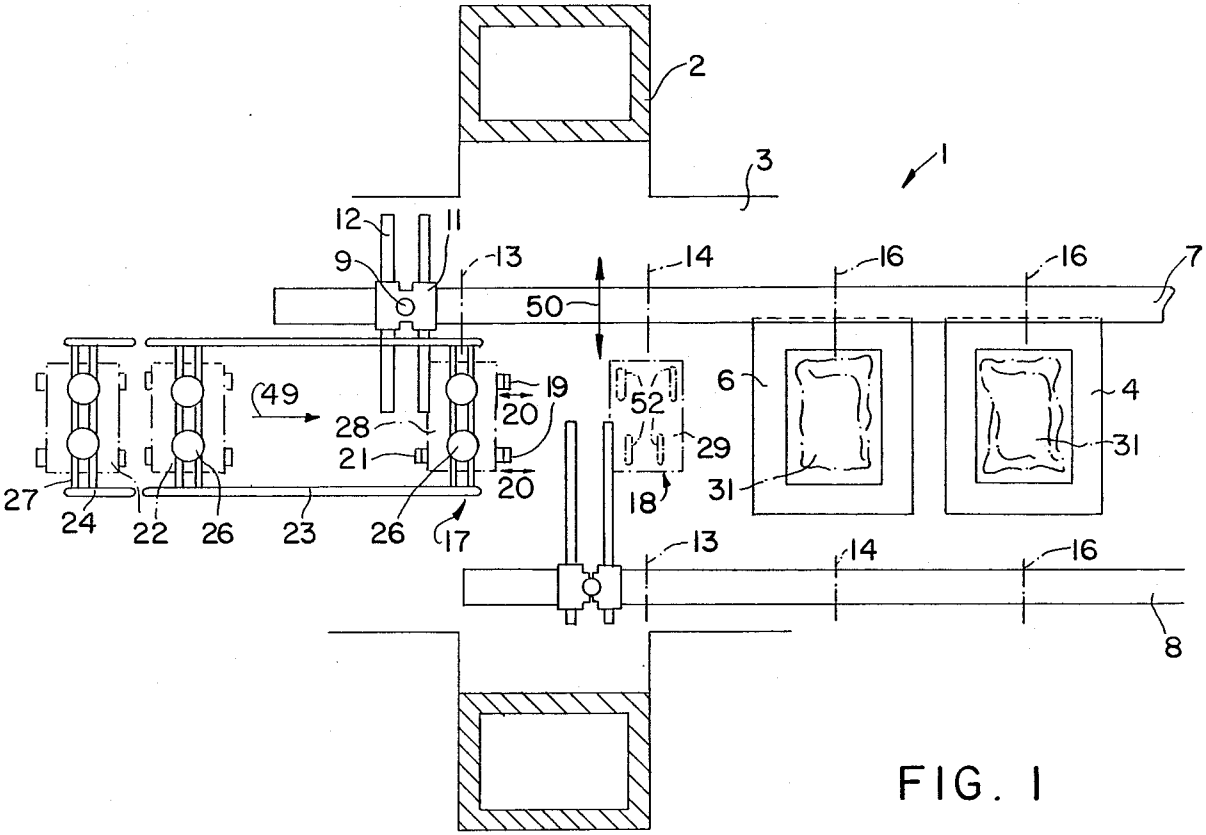
FIG. 1 is a simplified representation of the feeding arrangement with a view onto the conveying level of the sheet-metal blanks.

Referring now to the drawings wherein like reference numerals are used to designate like parts and more particularly to FIG. 1, wherein press 1 is only suggested and shown in the area of the feeding of the sheet-metal blanks, witht he columns 2 and the bottom platen 3. One transfer rail 7 and 8 respectively extends on both sides of the tools 4 and 6 in the the direction 49 of the passage through the press. The transfer rail 8 is shown in a return movement. No other bearing or sliding and guiding means are shown for the transfer rails 7, 8. The adjusting possibility of the transfer rails in the opening and closing direction 50 is indicated by means of the vertical rod 9, the adjusting head 11 and the crossrods 12. The transfer rails, in addition can also be driven in transfer direction—which corresponds to the passage direction 49 through the press—and in the lifting and lowering direction 51. The machining stage 6 that is first in the direction of the passage through the press in this case is developed as a drawing stage, the second and each additional machining stage has the number 4 and is used for a further shaping of the workpieces 31. The workpieces 31, as sheet-metal blanks 28, 29, are fed to the press and via a first conveying means 23 and possibly a second conveying means 24, are taken from supply piles 22 via suction lifting means 26, 27, are deposited on a roller conveyor or fed directly to a first intermediate depositing station 17. Beyond the original length that has been required for receiving the workpieces 31 from the first machining station 6 in order to transport them to the next machining station 4 and deposit them in the existing tool, the gripper rails are extended into the area of the first intermediate depositing station 17 and in it have passive gripping tools 13 which are described with respect to FIGS. 2 and 3. The sheet-metal blank 28 which is deposited in the first intermediate depositing station 17 on a flat plane which, for example, may be formed by the roller conveyor of the feeding device, is gripped with the movement of the transfer rails and deposited in a second intermediate depositing station 18. In this position, the present sheet-metal blank 29 can be gripped by means of active gripping tools 14 described, for example, in DE-AS No. 18 02 630 and from this position, by means of the movement of the transfer rails 7, 8 can be deposited in the tool of the drawing stage 6. Position 16 refers to other gripping tools required for the transport of the workpieces. The first intermediate depositing station 17 has spring-loaded stops 19 against which the sheet-metal blank 28 strikes when it first arrives. The return of the guiding movement of these stops 19 results in the fact that the sheet-metal blank rests uniformly against the fixed stops 21. The movement of the spring-loaded stops 19 is shown schematically by double-headed arrows 20. The sheet-metal blank is then aligned in passage direction 49 through the press with respect to the drawing stage 6. In order to avoid a sagging of the sheet-metal blank 28 during the transport from the intermediate depositing station 17 into the intermediate depositing station 18, the roller conveyor may be extended beyond the second intermediate depositing station 18. The position of a ferromagnetic sheet-metal blank 29 may be secured here, for example, by magnetic means 52. The alignment of the sheet-metal blank transversely to the direction 49 of the passage through the press takes place by the closing movement 50 of the transfer rails 7,8 where a resting takes place against corresponding stops mounted at the gripping devices 13. These stops are formed by the shaped parts 45, 46 as described in detail in FIGS. 2 and 3.

Figure 2:
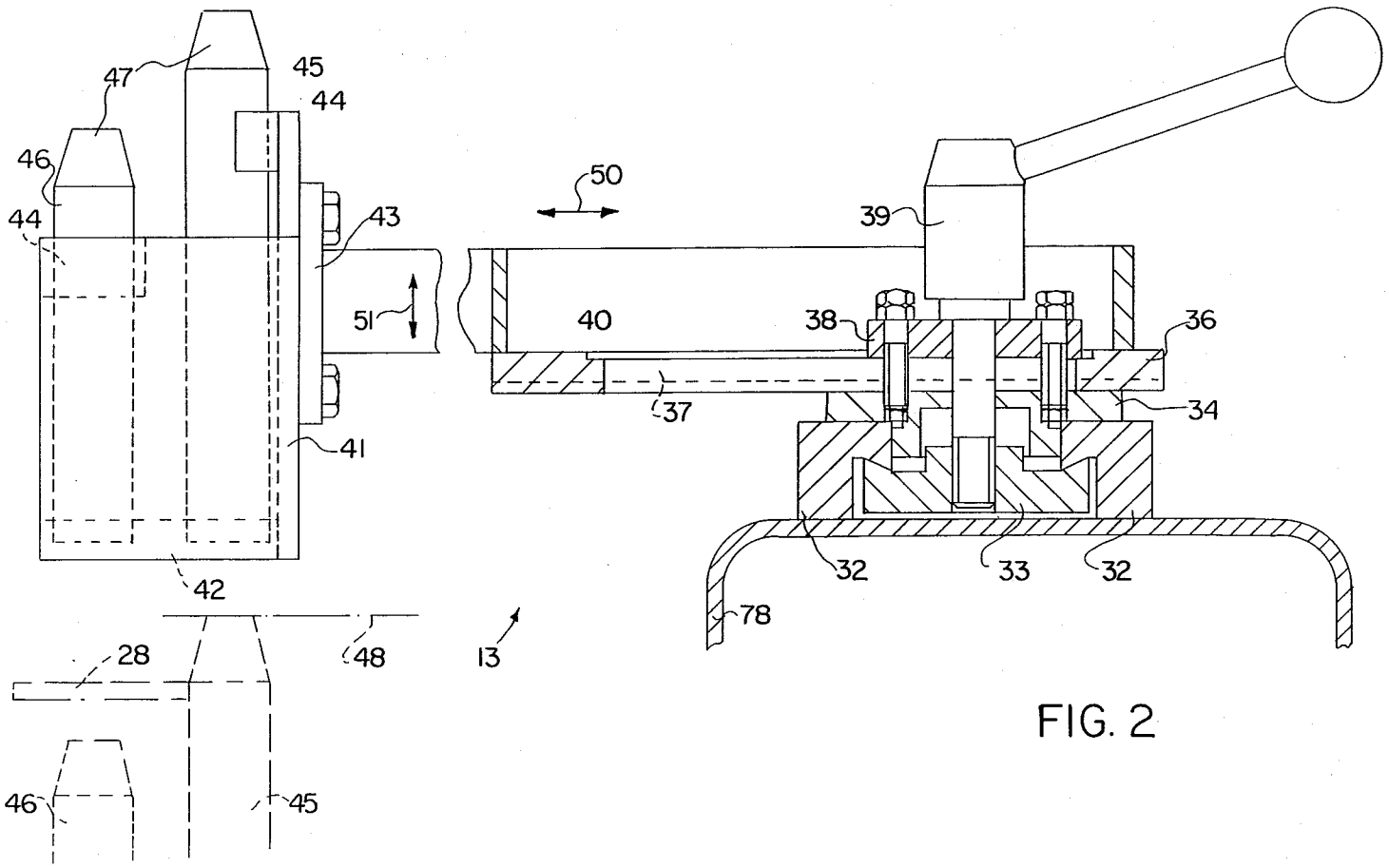
FIG. 2 is a partial section of a gripping tool fastened at a transfer rail.
Figure 3:
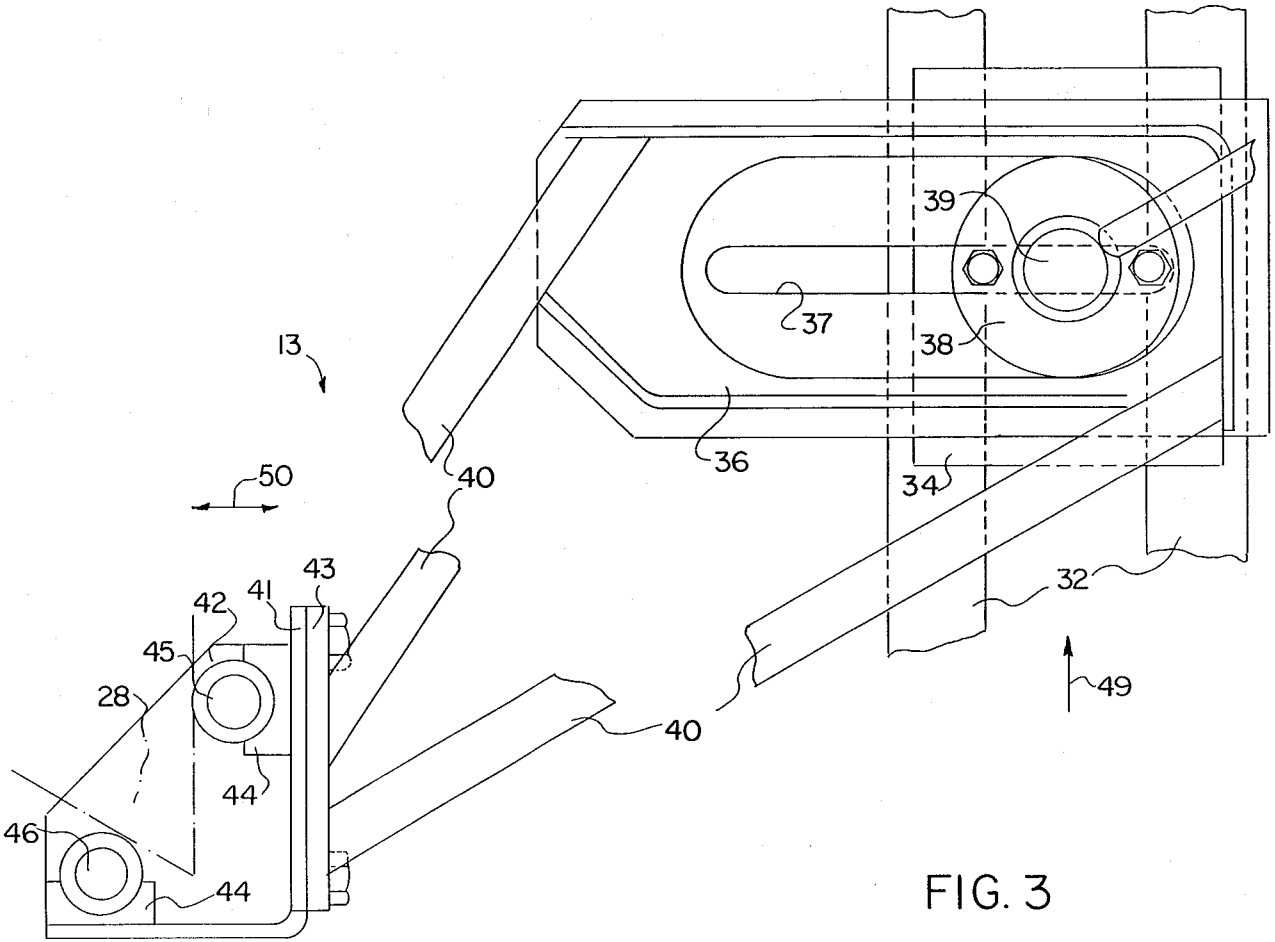
FIG. 3 is a top view of the gripping tool according to FIG. 2.

FIGS. 2 and 3 show a passive grippng device 13 which is fastened at the top side of the transfer rail 7 and 8. For this purpose, one—or as shown—two runners 32 rigidly mounted at the transfer rail are used, a carriage 34 that can be moved in passage direction (49) (FIG. 1) at said runners 32, a cross slide 36 disposed at said carriage 34 and slidable in transverse direction, a pressure plate 38 and only one spanner 39 and one clamping jaw 33. For purposes of adjustment, the gripping tool can be adjusted by the loosening of the clamping jaw 39 in the direction of the passage through the press and transversely to it. For the transverse adjustability, the cross slide 36 has an oblong hole 37. The cross slide 36 is extended by one or several brackets 40 which angular plates 41 are connected via console plates 43. In the embodiment, two brackets 40 are connected to the fixing means for receiving a gripping member. As a function of the sheet-metal blank 28 (FIG. 1), other gripping members may be arranged at a fixing means. The angular plate 41 carries a base plate 42 into which shaped pieces 45, 46 are inserted or shaped pieces 45, 46 are placed onto said base plate 42. The shaped pieces 45, 46 in this case are developed as cylindrical bolts which via bearing blocks 44 are supported at the angular plate 41. The shaped pieces or cylindrical bolts 45, 46 are chamfered at 47 or, in these areas, have a strong draft, for a besser entering of the sheet-metal blanks and in order to avoid tilting. In addition, FIG. 2 shows shaped pieces 45, 46 in a lowered position with an end part of a sheet-metal blank 28 to be received.

Corresponding to FIG. 2, the shaped pieces 45, 46 have different heights. The cylinder 45 projects over the cylinder 46 by an extent that is identical to or larger than the thickest sheet-metal thickness to be machined, such as that of a trapezoid sheet-metal blank 28. The interrupted line in FIG. 3 refers to the area of a trapezoid sheet-metal blank to be gripped by the gripping tool. The application 50 of the gripping tools 13 to the blank 28 takes place in the lowered position 51 (FIG. 2) of the transfer rail 7, 8 in which case first only the shaped piece 45 comes to rest against the sheet-metal blank 28. In the case of this motion, the alignment takes place in the direction of the arrow 50, thus transversely to the passage direction 49 through the press. During the upward motion (lifting) of the transfer rails 7, 8, the shaped piece 46 comes to rest against the edge of the sheet-metal blank 28.

While I have shown and described only one embodiment in accordance with the present invention, it is understood that the same is not limited thereto but is susceptible to numerous changes and modifications as known to one having ordinary skill in the art and I therefore do not wish to be limited to the details shown and described herein, but intend to cover all such modifications as are encompassed by the scope of the appended claims.

I claim:

1. An apparatus for the feeding of sheet-metal blanks comprising, at least one machining stage to which said sheet-metal blanks are fed, said at least one machining stage including at least a first machining stage comprising a drawing stage of a transfer press, a supply pile from which said sheet-metal blanks are taken, an intermediate depositing stage adjacent said supply pile, conveying means for taking sheet-metal blanks from said supply pile and for depositing them in the intermediate depositing stage adjacent said supply pile, for taking them from said intermediate depositing stage and for transporting and depositing them in the first machining stage adjacent said intermediate depositing stage, and having transfer rails that can be driven in transfer direction, in lifting and lowering direction and in closing and opening direction, and having gripping devices attached to said transfer rails for the transport of the workpieces to and between the at least one machining stage, said intermediate depositing stage including a first intermediate depositing station in front of the first machining stage being developed as an aligning station for the sheet-metal blanks with respect to the first machining stage and having one of fixed and movable stop means for the alignment of the sheet-metal blanks at least in the direction of the passage through the press, and wherein the transfer rails are extended and can thus be guided into an area of the first intermediate depositing station, said intermediate depositing stage further including a second intermediate deposition station, and passive gripping means for reaching under the sheet-metal blanks during the transfer and for depositing said sheet-metal blanks in said second intermediate depositing station, and active gripping means for gripping said sheet-metal blanks irrespective of the movement of said transfer rails and for removing the sheet-metal blanks from said second intermediate depositing station, for the gripping, transport and depositing in the first machining stage.

2. An arrangement according to claim 1, wherein the passive gripping means, in addition to one respective bearing surface, also have first shaped pieces against which the sheet-metal blanks rest in the direction of the passage of the workpieces through the transfer press, and second shaped pieces against which the sheet-metal blanks rest during the closing movement of the transfer rails.

3. An arrangement according to claim 2, wherein the first and second shaped pieces are cylindrical bolts disposed in the base plate via bearing blocks at an angular plate.

4. An arrangement according to claim 2, wherein the first and second shaped pieces have drafts for the entering of the sheet-metal blanks in the passive gripping means.

5. An arrangement according to claim 2, wherein the first shaped pieces of the passive gripping means for the transverse alignment project over the second shaped pieces for the longitudinal alignment.

6. An arrangment according to claim 1, wherein the passive gripping means, via a fixing arrangement, are mounted at the transfer rails so that the passive gripping means can be adjusted and fixed in the direction of the passage through the press and substantially transversely to that direction.

7. An arrangement according to claim 6, wherein the fixing arrangment has at least one runner fastened at at least one of said transfer rails, said runner extending in the direction of the longitudinal extension of said one transfer rail, a carriage slidably arranged in said one transfer rail, a cross slide directed transversely to the runner, said cross slide being disposed at the carriage so that it can be moved substantially transverse to the runner for receiving the passive gripping means and clamping means for the joint arresting of the cross slide and the carriage at the runner.

8. An arrangement according to claim 1, further comprising holding means disposed in the area of the second intermediate depositing station at conveying level, aligned corresponding to the shape of the sheet-metal blank.

9. An arrangement according to claim 3, wherein the first and second shaped pieces have drafts for the entering of the sheet-metal blanks in the passive gripping means.

10. An arrangement according to claim 3 wherein the first shaped pieces of the passive gripping means for the transverse alignment project over the second shaped pieces for the longitudinal alignment.

* * * * *